US006963323B2

(12) United States Patent
Sakurai et al.

(10) Patent No.: US 6,963,323 B2
(45) Date of Patent: Nov. 8, 2005

(54) POWER SUPPLY AND REFERENCE VOLTAGE CIRCUIT FOR TFT LCD SOURCE DRIVER

(75) Inventors: Takaaki Sakurai, Sagamihara (JP); Yoshiteru Watanabe, Kawasaki (JP); Toshiyuki Yana, Yokohama (JP); Satoshi Karube, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 166 days.

(21) Appl. No.: 10/156,581

(22) Filed: May 24, 2002

(65) Prior Publication Data

US 2002/0175662 A1 Nov. 28, 2002

(30) Foreign Application Priority Data

May 24, 2001 (JP) ..... 2001-156177

(51) Int. Cl.[7] ..... G09G 3/36
(52) U.S. Cl. ..... 345/89; 345/99
(58) Field of Search ..... 345/87–100, 211, 345/212, 204, 690

(56) References Cited

U.S. PATENT DOCUMENTS 6,127,995 A * 10/2000 Furuhashi et al. ..... 345/96
6,331,844 B1 * 12/2001 Okumura et al. ..... 345/87
6,518,962 B2 * 2/2003 Kimura et al. ..... 345/211

* cited by examiner

*Primary Examiner*—Kent Chang
(74) *Attorney, Agent, or Firm*—Jay H. Anderson

(57) ABSTRACT

A liquid crystal power supply is provided which generates a high-precision drive power supply voltage supplied to a driver circuit by using a low-precision reference voltage generating circuit. The power supply circuit includes a DC/DC converter which generates a voltage having a size based on an oscillation signal from a power supply voltage and outputs the generated voltage as a drive power supply voltage; a stabilized power supply circuit which generates a highest-level reference potential for generating a gray-scale voltage in a driver circuit; a comparison unit which outputs a difference voltage according to a difference between the drive power supply voltage and the highest-level reference potential; an internal reference voltage generating unit; an error amplifying unit which amplifies a difference between the reference voltage and the difference voltage; and a PWM conversion unit which outputs an oscillation signal in response to the amplified difference.

10 Claims, 8 Drawing Sheets

IN CASE WHERE TOLERANCE OF $V_{dcdc}$ OF LIQUID CRYSTAL DRIVE POWER SUPPLY CIRCUIT = 4%

POWER SUPPLY AND REFERENCE VOLTAGE CIRCUIT FOR TFT LCD SOURCE DRIVER

FIELD OF THE INVENTION

The present invention relates to a circuit for generating a power supply voltage of a source driver for a liquid crystal display panel and a reference voltage used for generating a gray-scale voltage in the source driver for a liquid crystal display panel; a method for generating the power supply voltage and the reference voltage; and a display device provided with the liquid crystal power supply circuit.

BACKGROUND OF THE INVENTION

A display device is an essential user interface for many types of electronic devices. Among a variety of display devices, a liquid crystal display (LCD) is often used since it meets several requirements, namely that the electronic device be light, thin, short and small and consume minimum power.

Particularly in recent years, liquid crystal displays have been utilized not only for small and lightweight portable type electronic devices but also in computer or television displays, because of their space-saving and power-saving characteristics.

FIG. 5 is a block diagram schematically showing a configuration of a conventional liquid crystal display module. As shown in FIG. 5, the liquid crystal display module includes a liquid crystal power supply circuit 100, a reference potential generating circuit 150, a source driver 160, a scan driver 170 and a liquid crystal display panel 180. The module generally also includes a controller for generally controlling these components and a backlight unit (not shown in FIG. 5).

The liquid crystal power supply circuit 100 generates a drive power supply voltage $V_{dcdc}$ supplied to the source driver 160, and a highest-level reference potential $V_{refH}$ supplied to the reference potential generating circuit 150. The reference potential generating circuit 150 generates a plurality of reference potentials $V_{ref0}$ to $V_{refn}$ required for generating a gray-scale voltage in the source driver 160; this may be done by using a resistor dividing network based on the highest-level reference potential $V_{refH}$ supplied by liquid crystal power supply circuit 100.

The source driver 160 includes (1) a latch circuit 166 for latching digital image data $D_0$ to $D_m$ inputted thereto from the outside with the drive power supply voltage $V_{dcdc}$ supplied from the liquid crystal power supply circuit 100; (2) a D/A converter 164 for converting the digital image data $D_0$ to $D_m$, latched by the latch circuit 166, into analog signals by using the reference potentials $V_{ref0}$ to $V_{refn}$ from the reference potential generating circuit 150; and (3) an output circuit 162 for buffering and outputting the analog signals outputted from the D/A converter 164 as a plurality of analog image signals $Y_0$ to $Y_k$.

A scan driver 170 outputs scan signals $X_0$ to $X_i$ in a specified cycle. A liquid crystal display panel 180 has a plurality of pixel cells arrayed in a matrix. The liquid crystal display panel 180 may be (for example) an active matrix drive type display, in which ON/OFF of each pixel cell is controlled by a thin film transistor (TFT). The liquid crystal display panel 180 displays an image determined by the analog image signals $Y_0$ to $Y_k$ of the source driver 160 and the scan signals $X_0$ to $X_i$ of the scan driver 170.

As described above, in the conventional liquid crystal display module, the plurality of reference potentials $V_{ref0}$ to $V_{refn}$ must be supplied to the source driver 160. In addition, the source driver 160 calculates an analog image signal having a certain size by applying the reference potentials $V_{ref0}$ to $V_{refn}$ and the digital image data $D_0$ to $D_m$ to show a gray-scale degree of each pixel cell, in accordance with a specified equation.

The reference potential generating circuit 150 generates the reference potentials $V_{ref0}$ to $V_{refn}$ based on the highest-level reference potential $V_{refH}$. This highest-level reference potential $V_{refH}$ outputted from the liquid crystal power supply circuit 100, therefore determines the size of the maximum analog image signal inputted to the liquid crystal display panel 180.

In general, the maximum voltage that the source driver 160 can output has an upper limit given by subtracting the voltage required by the output circuit 162 for the driver from the drive power supply voltage $V_{dcdc}$. If the drive power supply voltage $V_{dcdc}$ is unstable, then the maximum voltage that the power supply can output is likewise unstable. In particular, in the source driver 160, the maximum voltage capable of being outputted and the maximum analog image signal outputted to the liquid crystal display panel 180 approximately coincide with each other in voltage.

Accordingly, the drive power supply voltage $V_{dcdc}$ and the highest-level reference potential $V_{refH}$, which are both generated in the power supply circuit 100, are required to be stable with high precision; in general, the performance of the liquid crystal power supply circuit 100 determines the quality of the entire liquid crystal display module.

A more detailed description of the configuration and operation of the conventional liquid crystal power supply circuit 100 is as follows. The drive power supply voltage $V_{dcdc}$ and the highest-level reference voltage $V_{refH}$ for the source driver 160 are required to be voltages determined by the design of the liquid crystal display panel 180 or by a property of the liquid crystal material. These voltages are different from a power supply voltage $V_{cc}$ required for driving the liquid crystal power supply circuit 100 itself. Therefore, in the liquid crystal power supply circuit 100, in order to generate the drive power supply voltage $V_{dcdc}$ from the power supply voltage $V_{cc}$, a DC/DC converter is used in many cases. The drive power supply voltage $V_{dcdc}$ and the highest-level reference voltage $V_{refH}$ may then be set to have higher values than that of the power supply voltage $V_{cc}$ of the liquid crystal power supply circuit 100. Accordingly, the liquid crystal power supply circuit 100 includes a boost type DC/DC converter 130 and a DC/DC converter control circuit 120 for controlling the DC/DC converter 130 in order to generate the drive power supply voltage $V_{dcdc}$ for the source driver 160.

The DC/DC converter control circuit 120 includes a pulse width modulation (PWM) conversion unit 122, an internal reference voltage generating unit 124 and an error amplifying unit 126. The liquid crystal power supply circuit 100 also includes resistors R11 and R12 for dividing an internal reference voltage $V_{REF}$ generated by the internal reference voltage generating unit 124, and resistors R13 and R14 for dividing the drive power supply voltage $V_{dcdc}$ outputted from the DC/DC converter 130.

The error amplifying unit 126 has a non-inverted input given by the voltage obtained by dividing the internal reference voltage $V_{REF}$ with the dividing network of resistors R11 and R12, and an inverted input given by the voltage obtained dividing the drive power supply voltage $V_{dcdc}$ with the dividing network of resistors R13 and R14; the error amplifying unit 126 outputs a voltage in accordance with the difference between these voltages. The PWM conversion unit 122 outputs an oscillation signal $V_{out}$ having a pulse width in accordance with the difference voltage outputted from the error amplifying unit 126.

Therefore, if the resistance values of resistors R11, R12, R13 and R14 are chosen so that the voltage obtained by the resistor dividing network of R13 and R14 and the voltage obtained by the resistor dividing network of R11 and R12 are equal when the drive power supply voltage $V_{dcdc}$ has a target value, then it is possible to realize feedback control for setting at zero, a difference between this target value and the drive power supply voltage $V_{dcdc}$ actually outputted. Using this feedback control, the liquid crystal power supply circuit 100 can output a stable drive power supply voltage $V_{dcdc}$ coincident with the target value.

In addition, the liquid crystal power supply circuit 100 includes a stabilized power supply circuit 140. The stabilized power supply circuit 140 is a power supply regulator having a tolerance of, for example, 2% in the generated voltage. The stabilized power supply circuit 140 generates the highest-level reference potential $V_{refH}$ from the power supply voltage $V_{cc}$ of the liquid crystal power supply circuit 100.

Note that the highest-level reference voltage $V_{refH}$ can be generated not only by the stabilized power supply circuit 140 as shown in FIG. 5, but also by dividing the drive power supply voltage $V_{dcdc}$ outputted from the DC/DC converter 130 of the liquid crystal power supply circuit 100 in a resistor dividing network. FIG. 6 is a diagram showing an example of a liquid crystal display module when the highest-level reference potential $V_{refH}$ is generated by a resistor dividing network. In FIG. 6, illustration of the components other than those corresponding to the liquid crystal power supply circuit 100 shown in FIG. 5 is omitted.

In a liquid crystal power supply circuit 200 shown in FIG. 6, $V_{refH}$ is the voltage obtained by dividing the drive power supply voltage $V_{dcdc}$ outputted from the DC/DC converter 130 in a resistor dividing network of resistors R21 and R22. This eliminates the need for the stabilized power supply circuit 140 shown in FIG. 5.

In the conventional liquid crystal display module described above, the maximum gray-scale voltage of the source driver 160 is determined by the highest-level reference potential $V_{refH}$, the maximum voltage that the source driver 160 can output is limited to a value somewhat lower than the drive power supply voltage $V_{dcdc}$, and the maximum voltage that the source driver 160 must output usually coincides with the voltage of the highest-level reference potential $V_{refH}$. Therefore, the drive power supply voltage $V_{dcdc}$ must be higher than the highest-level reference potential $V_{refH}$ by a certain size.

However, the source driver 160 cannot receive a drive power supply voltage above a specified maximum value. For this reason, in the actual design of the liquid crystal display module, the maximum voltage that the source driver 160 must output (that is, the voltage of the highest-level reference potential $V_{refH}$) is set approximately equal to the drive power supply voltage of the source driver 160.

FIG. 7 shows typical voltage values in a conventional liquid crystal power supply circuit. It is assumed here that the maximum voltage the source driver 160 must output is equal to the voltage of the highest-level reference potential $V_{refH}$ and that the minimum voltage difference required between the maximum voltage and the drive power supply voltage $V_{dcdc}$ of the source driver 160 (hereinafter, referred to as an upper rail voltage) is 0.2 V.

In the example of FIG. 7, it is also assumed that an upper limit of the power supply voltage that can be inputted to the source driver 160 is 16.00 V and that a designed central value of the highest-level reference potential $V_{refH}$ is 15.00 V. It is also assumed that a high-precision power supply regulator having a tolerance of 2% in the generated voltage is used as the stabilized power supply circuit 140. Accordingly, as shown in FIG. 7, the maximum value of the highest-level reference potential $V_{refH}$ becomes 15.30 V (=15.00×1.02), and the minimum value thereof becomes 14.70 V (=15.00×0.98).

As described above, since the drive power supply voltage $V_{dcdc}$ supplied to the source driver 160 is required to be larger than the highest-level reference potential $V_{refH}$ by an amount of the upper rail voltage, the drive power supply voltage $V_{dcdc}$ is required to be set at least at 15.50 V, which is larger than 15.30 V by 0.2 V. 15.30 V is the maximum value of the highest-level reference potential $V_{refH}$.

Consequently, in this example, a liquid crystal power supply circuit 100 which generates a drive power supply voltage $V_{dcdc}$ in a range of 15.50 V to 16.00 V is required. In other words, in the liquid crystal power supply circuit 100, a high-precision voltage generating circuit having a tolerance of 1.59% in the generated voltage at the designed central voltage of 15.75 V is required. This means that the internal reference voltage generating unit 124 in the DC/DC converter control circuit 120 generates an internal reference voltage $V_{REF}$ having a tolerance of 1.59% in the generated voltage. An internal reference voltage generating unit 124 with such high precision is costly and is not suitable for mass production.

Typically, in an inexpensive DC/DC converter control circuit 120 equipped with an IC, the tolerance of the generated voltage in the internal reference voltage generating unit 124 is about 4%. As a second example of the liquid crystal power supply circuit, a liquid crystal power supply circuit 100 will be described which includes such an inexpensive DC/DC converter control circuit 120.

FIG. 8 shows typical voltage values in this second example of a conventional liquid crystal power supply circuit. As in the first example, it is assumed that (1) the maximum voltage the source driver 160 must output is equal to the highest-level reference potential $V_{refH}$; (2) the upper rail voltage is 0.2 V; and (3) the tolerance of the generated voltage ($V_{refH}$) in the stabilized power supply circuit 140 is 2%. In addition, it is assumed that the upper limit of the power supply voltage of the source driver 160 is 16.00 V, and that the tolerance of the generated voltage ($V_{dcdc}$) in the liquid crystal power supply circuit 100 (and thus the tolerance of the generated voltage $V_{REF}$ in the internal reference voltage generating unit 124) is 4%.

In this case, as shown in FIG. 8, the maximum value of the drive power supply voltage $V_{dcdc}$ becomes 16.00 V, and a designed central voltage thereof is calculated to be about 15.38 V (=16.00/1.04), and the minimum value thereof is calculated to be about 14.77 V (=15.38×0.96). The upper rail voltage is 0.2 V. From these values, the maximum value of the highest-level reference potential $V_{refH}$ is obtained as 14.57 V by subtracting 0.2 V of the upper rail voltage from 14.77 V (that is, the minimum value of the drive power supply voltage $V_{dcdc}$). Furthermore, the tolerance of the generated voltage in the stabilized power supply circuit 140 is 2%. Therefore, the designed central voltage of the highest-level reference potential $V_{refH}$ is calculated to be about 14.28 V (=14.57/1.02), and the minimum value thereof is calculated to be about 14.00 V (=14.28×0.98).

Therefore, according to this trial calculation, since the designed central voltage of the highest-level reference potential $V_{refH}$ is about 14.28 V, the liquid crystal power supply circuit 100 cannot give a sufficiently large highest-level reference potential $V_{refH}$ to the reference potential generating circuit 150. In other words, in order to carry out an image display in response to the specification of the liquid crystal display panel 180, the boosting capability of the DC/DC converter 130 and the upper limit of the power supply voltage of the source driver 160 of the liquid crystal power supply circuit 100 must be increased, resulting in an increase of the cost for manufacturing the liquid crystal display module.

If the difference between the drive power supply voltage $V_{dcdc}$ and the highest-level reference potential $V_{refH}$ is lowered to the upper rail voltage or less, and if the designed central voltage of the highest-level reference potential $V_{refH}$ is increased in order to secure a sufficiently large highest-level reference potential $V_{refH}$, then an undesirable gap will exist between the maximum output voltage of the source driver 60 and the designed value; an unwanted offset voltage may thus be added to the analog image signal outputted to the liquid crystal display panel 180.

Note that, in the trial calculations according to the above-described first and second examples, no consideration has been given to tolerances in the resistors R11, R12, R13 and R14 externally attached to the DC/DC converter control circuit 120 and the DC/DC converter 130, or to dynamic voltage variations caused by load variations in the power supply. In the circuits described above, high-precision resistors are actually required in consideration of the specified tolerances. Therefore, the specifications for the liquid crystal power supply circuit 100 become stricter.

In the circuit of FIG. 6, in which the highest-level reference potential $V_{refH}$ is generated from the drive power supply voltage $V_{dcdc}$ by a resistor dividing network, a relation between the drive power supply voltage $V_{dcdc}$ and the highest-level reference potential $V_{refH}$ can be readily established. However, in this case, a voltage variation amount originating from the load variation of the drive power supply voltage $V_{dcdc}$ also appears in the highest-level reference potential $V_{refH}$, which will then cause deterioration of the image quality.

SUMMARY OF THE INVENTION

The present invention addresses the above-described problem by providing a liquid crystal power supply circuit which generates a drive power supply voltage for a source driver and a highest-level reference potential for generating a gray-scale voltage of a liquid crystal display panel, using of a DC/DC converter control circuit provided with a low-precision reference voltage supply, with a precision similar to that of a conventional circuit using a DC/DC converter control circuit provided with a high-precision reference voltage supply.

A power supply circuit according to a first aspect of the invention includes a drive power supply voltage generating circuit for generating a drive power supply voltage of a driver circuit for use in a display device, and a reference voltage generating circuit for generating a reference voltage for use in generating a gray-scale voltage in the driver circuit, wherein feed back control is performed to maintain a specified relation between the drive power supply voltage and the reference voltage.

The drive power supply voltage generating circuit of the present invention may further include a voltage output circuit for outputting the drive power supply voltage while changing an output value thereof in response to an inputted control signal, and a comparison circuit for comparing the drive power supply voltage and the reference voltage with each other to output a signal in response to a result of the comparison as the control signal. The reference voltage generating circuit may generate the reference voltage using a stabilized power supply circuit. The drive power supply voltage may also be outputted as a voltage having a stable voltage value.

The comparison circuit may include a difference amplifying circuit for outputting, as the control signal, a signal based on a difference voltage between a feedback voltage generated by a comparison operation between the drive power supply voltage and the reference voltage and a reference voltage generated independently of the drive power supply voltage and the reference voltage. Accordingly, the comparison circuit may include a difference amplifying circuit for generating a signal which is changed based on a difference between the feedback voltage (obtained by comparing the drive power supply voltage and the reference voltage with each other) and the reference voltage; this signal is not influenced by the drive power supply voltage and the reference voltage. Therefore, the drive power supply voltage may be changed based on a result of the comparison of the feedback voltage and the reference voltage.

Alternatively, the comparison circuit may include a difference amplifying circuit for outputting, as the control signal, a signal based on a difference voltage between a first feedback voltage generated by an operation for the drive power supply voltage and/or the reference voltage and a second feedback voltage generated by the operation for the drive power supply voltage and/or the reference voltage. Accordingly, this comparison circuit may include a difference amplifying circuit for generating a signal changed based on the difference between two feedback voltages generated by operating the drive power supply voltage and/or the reference voltage. Therefore, the drive power supply voltage may be changed based on a result of the comparison of the two feedback voltages.

In the above-described power supply circuit, the reference voltage generating circuit may generate the reference voltage from the drive power supply voltage. In particular, the reference voltage generating circuit may generate a reference voltage having a value lower than a value of the drive power supply voltage. Therefore, a series regulator or a shunt regulator may be used as a circuit for generating the reference voltage.

The above-described reference voltage generating circuit may generate a voltage corresponding to a maximum potential among a plurality of reference potentials required for generating a gray-scale voltage in the driver circuit, and output the generated voltage as the reference voltage. In addition, the reference voltage generating circuit may generate a voltage corresponding to a maximum potential among a plurality of reference potentials required for generating a gray-scale voltage in the driver circuit, and generate the plurality of reference potentials based on the generated voltage. In this case, the plurality of other reference potentials required for generating the gray-scale voltage can be generated by, for example, a resistor dividing network, based on the highest-level reference potential generated by the reference voltage generating circuit, and may then be supplied to the driver circuit.

The above-described voltage output circuit may further include a pulse width modulation (PWM) controller for outputting pulse signals, each having a width different from the other, in response to control signals outputted from the above-described comparison circuit; and a DC/DC converter controlled by the pulse signals. Accordingly, a general DC/DC converter and a PWM controller IC for subjecting the DC/DC converter to PWM control may be used for the drive power supply voltage generating circuit.

A power supply circuit according to another aspect of the invention includes a drive power supply voltage generating circuit for generating a drive power supply voltage of a driver circuit for use in a display device, and a reference voltage generating circuit for generating a reference voltage for use in generating a gray-scale voltage in the driver circuit; the drive power supply voltage generating circuit generates the drive power supply voltage with the reference voltage as a reference.

The drive power supply voltage generating circuit may further include a voltage output circuit for outputting the drive power supply voltage while changing an output value thereof in response to an inputted control signal; and a comparison circuit for comparing the drive power supply voltage and the reference voltage to output a signal in response to a result of the comparison as the control signal.

According to still another aspect of the invention, a driver circuit voltage generating method is provided which includes the following steps: a reference voltage generating step of generating a reference voltage for use in generating a gray-scale voltage in a driver circuit for use in a display device; and a drive power supply voltage generating step of generating a drive power supply voltage of the driver circuit with the reference voltage as a reference. The drive power supply voltage supplied to the driver circuit for use in the display device may be generated with the drive power supply voltage and the reference voltage for use in generating the gray-scale voltage in the driver circuit as references.

The above-described method may further include a comparing step of comparing the drive power supply voltage and the reference voltage to output a control signal in response to a result of the comparison, wherein the drive power supply voltage generating step changes a value of the drive power supply voltage in response to the control signal.

In the feedback control of the drive power supply voltage, the drive power supply voltage may be changed in response to the result of the comparison of the drive power supply voltage and the reference voltage. In addition, the reference voltage generating step may include a step of stabilizing the reference voltage. Accordingly, the drive power supply voltage may be changed in response to a result of the comparison of the drive power supply voltage and the stabilized reference voltage.

The reference voltage generating step in the above-described method may also include a reference potential generating step of generating a voltage corresponding to a maximum potential among a plurality of reference potentials required for generating a gray-scale voltage in the driver circuit, outputting the generated voltage as the reference voltage, and generating the plurality of reference potentials based on the reference voltage. Furthermore, the voltage generated in the reference voltage generating step becomes the highest-level reference potential in the driver circuit, while a plurality of other reference potentials required for generating the gray-scale voltage can be generated to be supplied to the driver circuit.

According to another aspect of the invention, a display device is provided which includes: a display panel including a plurality of pixels arrayed in a matrix and displaying an image by the plurality of pixels; a driver circuit for outputting a gray-scale voltage to the pixels based on a plurality of reference potentials; and a power supply circuit for outputting a drive power supply voltage for the driver circuit and a reference voltage for deciding the plurality of reference potentials. The power supply circuit performs feedback control to maintain a specified relation between the drive power supply voltage and the reference voltage.

In this display device, the power supply circuit includes a drive power supply voltage generating circuit for generating the drive power supply voltage, and a reference voltage generating circuit for generating the reference voltage; the drive power supply voltage generating circuit includes a voltage output circuit for outputting the drive power supply voltage while changing an output value thereof in response to an inputted control signal, and a comparing circuit for comparing the drive power supply voltage and the reference voltage to output a signal in response to a result of the comparison as the control signal.

The reference voltage generating circuit in the above-described display device may generate the reference voltage using a stabilized power supply circuit.

In the above-described display device, the reference voltage generating circuit in the power supply circuit may generate a reference voltage having a value lower than a value of the drive power supply voltage with the drive power supply voltage generated by the drive power supply voltage generating circuit as a power supply. Therefore, as the circuit for generating the reference voltage in the power supply circuit, a series regulator or a shunt regulator may be used.

The reference voltage generating circuit may generate a voltage corresponding to a maximum potential among the plurality of reference potentials, and output the generated voltage as the reference voltage.

The above-described display device may further include a reference potential generating circuit for generating the plurality of reference potentials based on the reference voltage. These reference potentials may be those required for generating the gray-scale voltage from the reference voltage outputted from the power supply circuit.

DETAILED DESCRIPTION OF THE PREFERRED EMBODIMENTS

Detailed descriptions will be made of embodiments of a power supply circuit, a driver circuit voltage generating method and a display device according to the present invention with reference to the drawings. It will be appreciated that the present invention is not limited to the described embodiments.

First Embodiment

Figure 1:
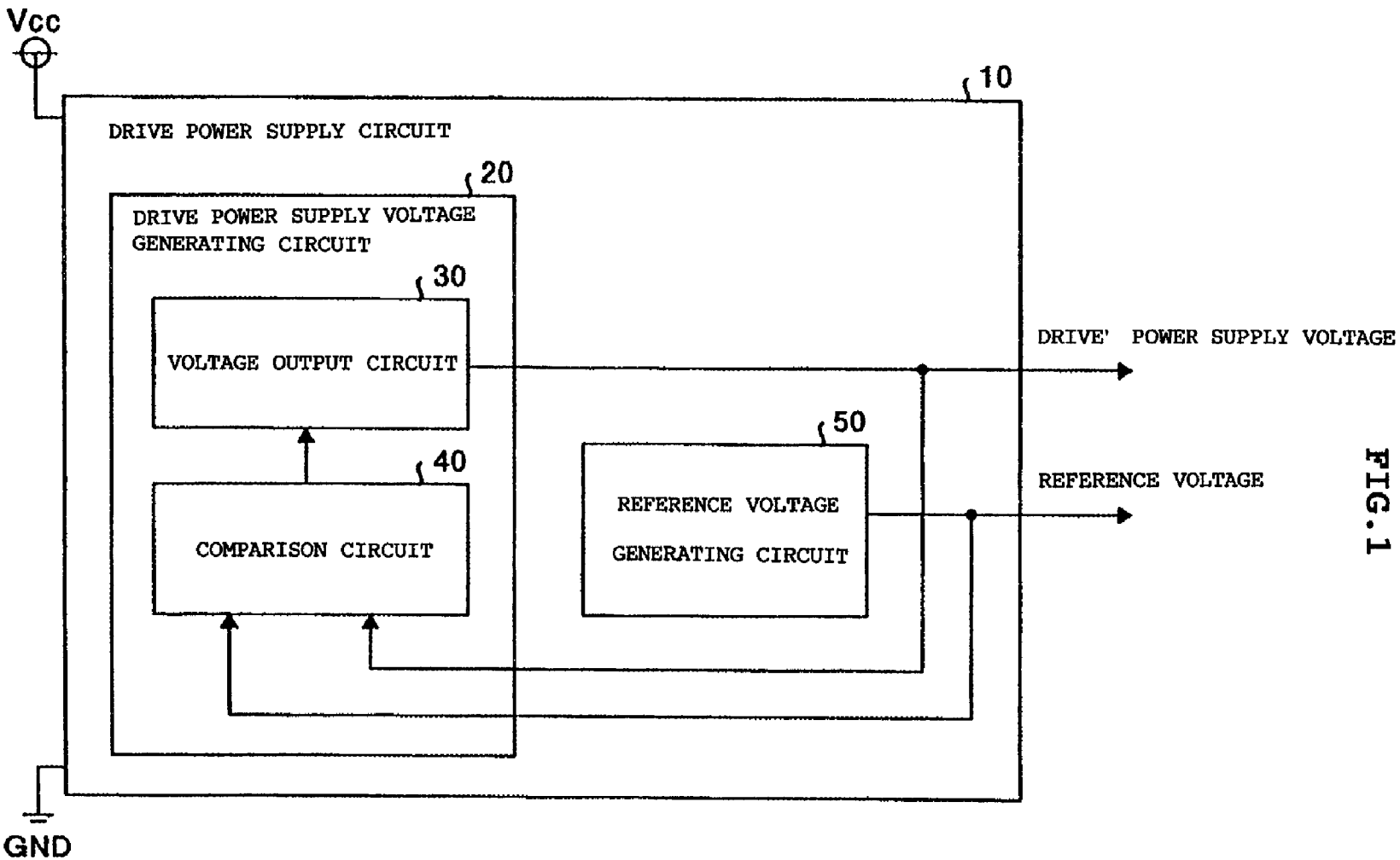
FIG. 1 is a block diagram schematically showing a configuration of a power supply circuit according to a first embodiment of the invention.

FIG. 1 is a block diagram schematically showing a configuration of the power supply circuit according to a first embodiment of the invention. As shown in FIG. 1, a power supply circuit 10 includes a drive power supply voltage generating circuit 20 for generating a drive power supply voltage of a driver circuit (source driver) for use in a display device, and a reference voltage generating circuit 50 for generating a reference voltage for use in generating a gray-scale voltage in the driver circuit (source driver).

The drive power supply voltage generating circuit 20 includes a voltage output circuit 30 and a comparison circuit 40. The comparison circuit 40 receives a drive power supply voltage generated and outputted by the drive power supply voltage generating circuit 20 and receives a reference voltage generated and outputted by the reference voltage generating circuit 50; circuit 40 outputs a control signal based on a result of a comparison operation of the power supply voltage and the reference voltage. Meanwhile, the voltage generating circuit 30 receives the control signal outputted from the comparison circuit 40, and changes the outputted value of the drive power supply voltage in response thereto.

In the comparison circuit 40, the voltage difference between the drive power supply voltage and the reference voltage may be simply outputted as the control signal by using an error amplifying circuit. The voltage values inputted to the comparison circuit may be reduced values of the power supply voltage and the reference voltage, obtained by using a voltage divider resistor network. Alternatively, the voltage difference between the drive power supply voltage and the reference voltage may first be obtained, and a result obtained by comparing this voltage difference with a second reference voltage generated independently of the drive power supply voltage and the foregoing reference voltage may be outputted as the control signal. The independently generated reference voltage may be generated based on the drive power supply voltage and/or the reference voltage. In general, the comparison circuit 40 outputs a certain relation such between the drive power supply voltage and the reference voltage (such as a difference or a ratio thereof) as the control signal.

The drive power supply voltage generating circuit 20 thus receives feedback based upon the drive power supply voltage generated by circuit 20, so that feedback control for maintaining a constant relation between the drive power supply voltage and the reference voltage is realized.

Therefore, in a circuit which realizes a voltage generating method according to this embodiment, the drive power supply voltage is generated so as to have a constant relation with the reference voltage (which is a stable reference voltage outputted from the reference voltage generating circuit 50). Accordingly, a stable drive power supply voltage may be outputted which (for example) always has a value higher than the reference voltage by an amount of an upper rail voltage.

Second Embodiment

A power supply circuit and a driver circuit voltage generating method according to a second embodiment will now be described. In particular, a circuit according to this embodiment may take the form of a liquid crystal power supply circuit mounted on a liquid crystal display module.

Figure 2:
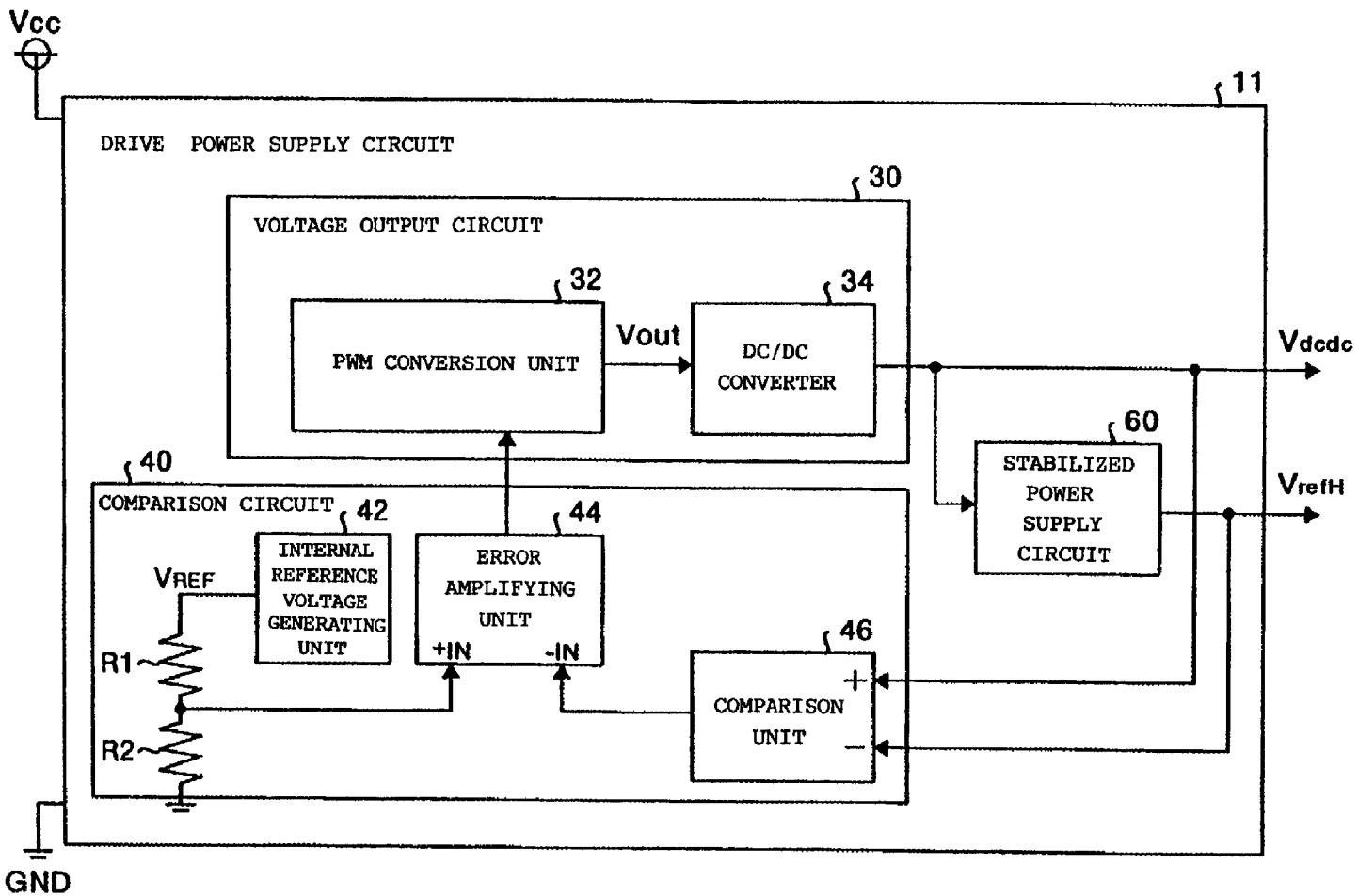
FIG. 2 is a block diagram schematically showing a configuration of a power supply circuit according to a second embodiment of the invention.

FIG. 2 is a block diagram schematically showing a configuration of the power supply circuit according to this embodiment. Note that portions common to those of FIG. 1 are denoted by the same reference numerals. In FIG. 2, a power supply circuit 11 includes a voltage output circuit 30, a comparison circuit 40 and a stabilized power supply circuit 60. The stabilized power supply circuit 60 corresponds to the reference voltage generating circuit 50 shown in FIG. 1.

The voltage output circuit 30 has a DC/DC converter 34 and a PWM conversion unit 32 for controlling the DC/DC converter 34. The comparison circuit 40 includes an internal reference voltage generating unit 42, an error amplifying unit 44, a comparison unit 46, and resistors R1 and R2 which form a voltage divider network for the internal reference voltage $V_{REF}$ outputted from the internal reference voltage generating unit 42.

Figure 5:
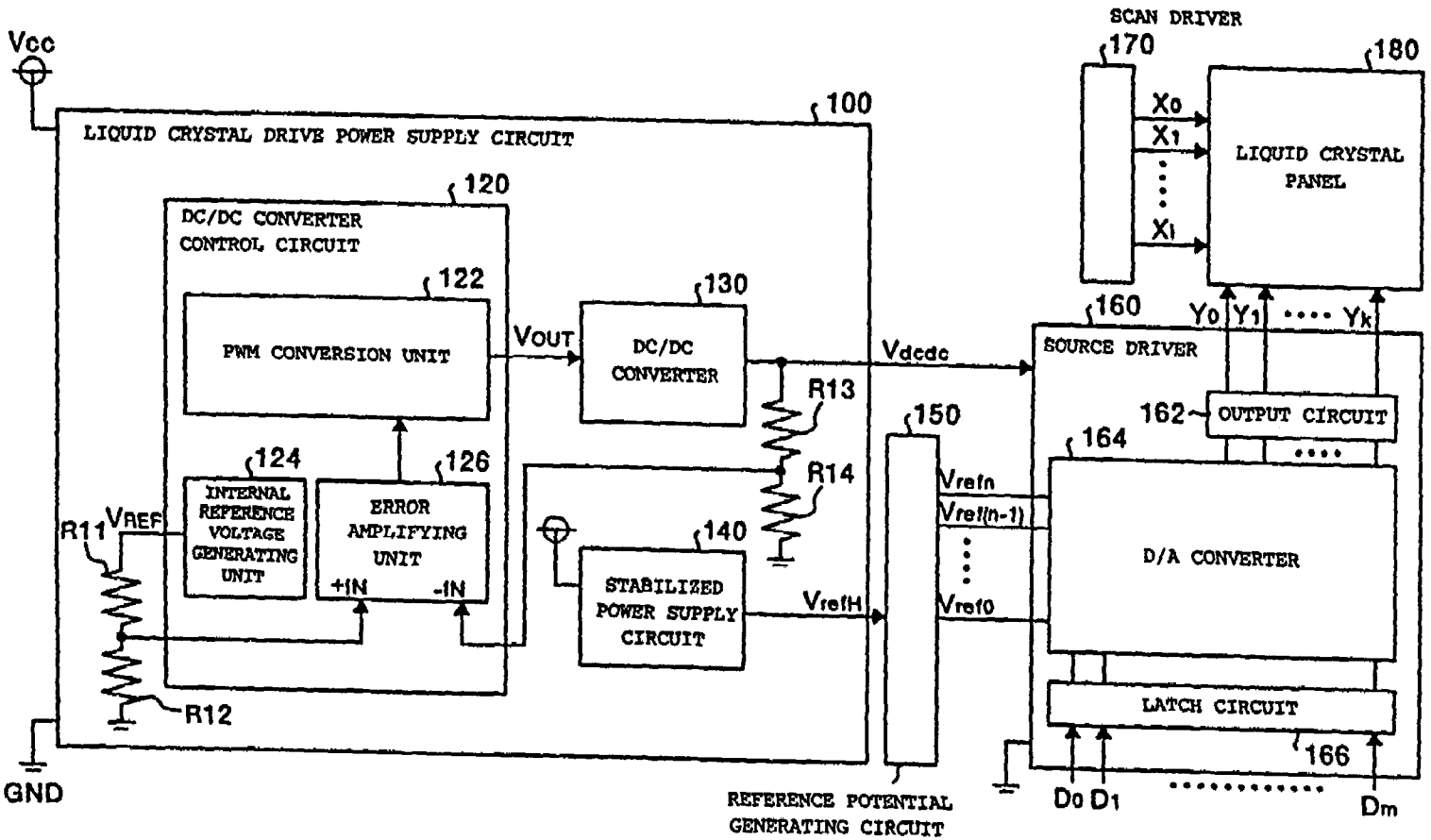
FIG.5 PRIOR ART
FIG. 5 is a block diagram schematically showing a configuration of a conventional liquid crystal display module.
Figure 6:
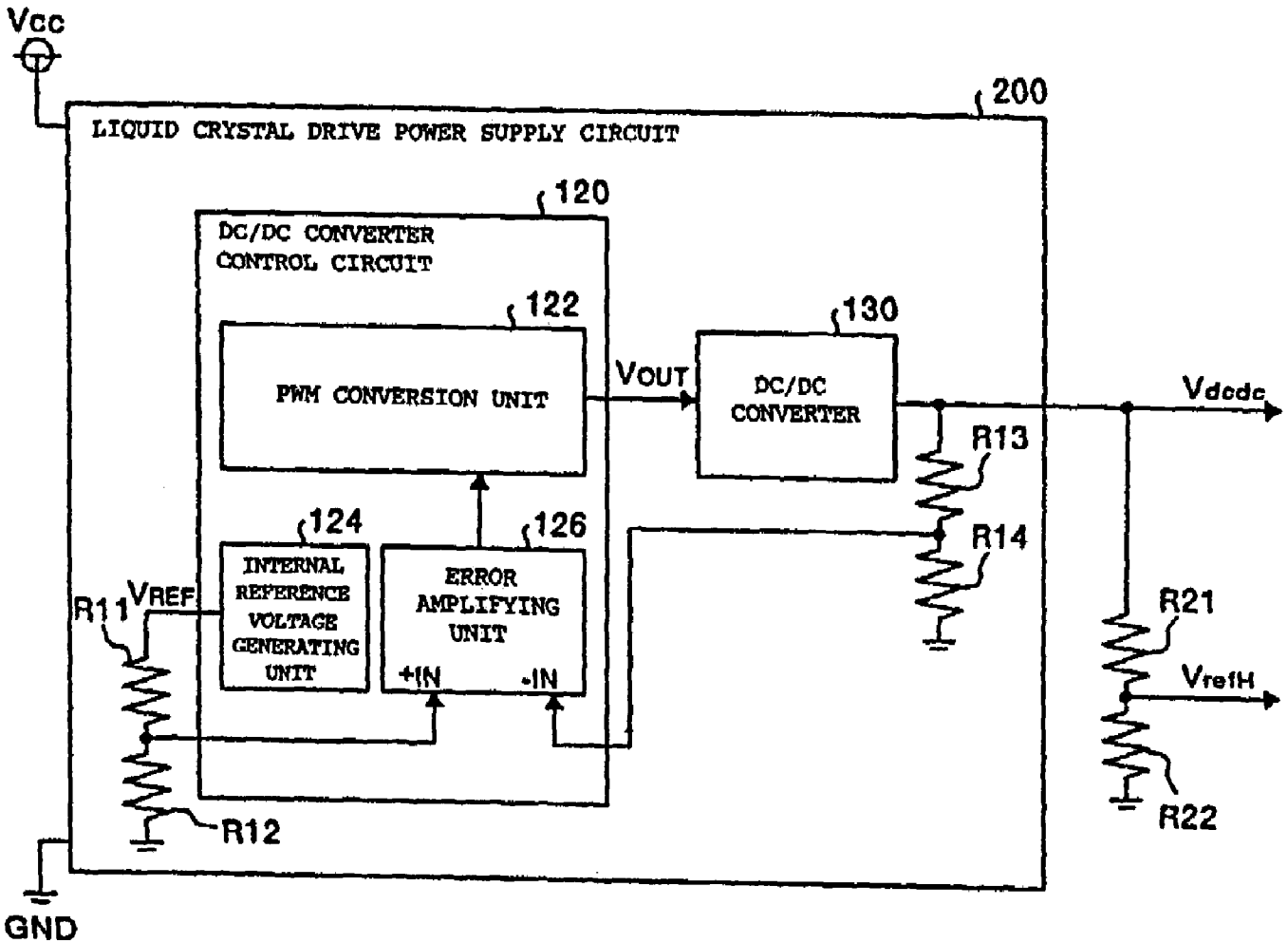
FIG. 6 PRIOR ART
FIG. 6 is a diagram showing an example of a conventional liquid crystal display module when a highest-level reference voltage is generated by resistor dividing network.
Figure 7:
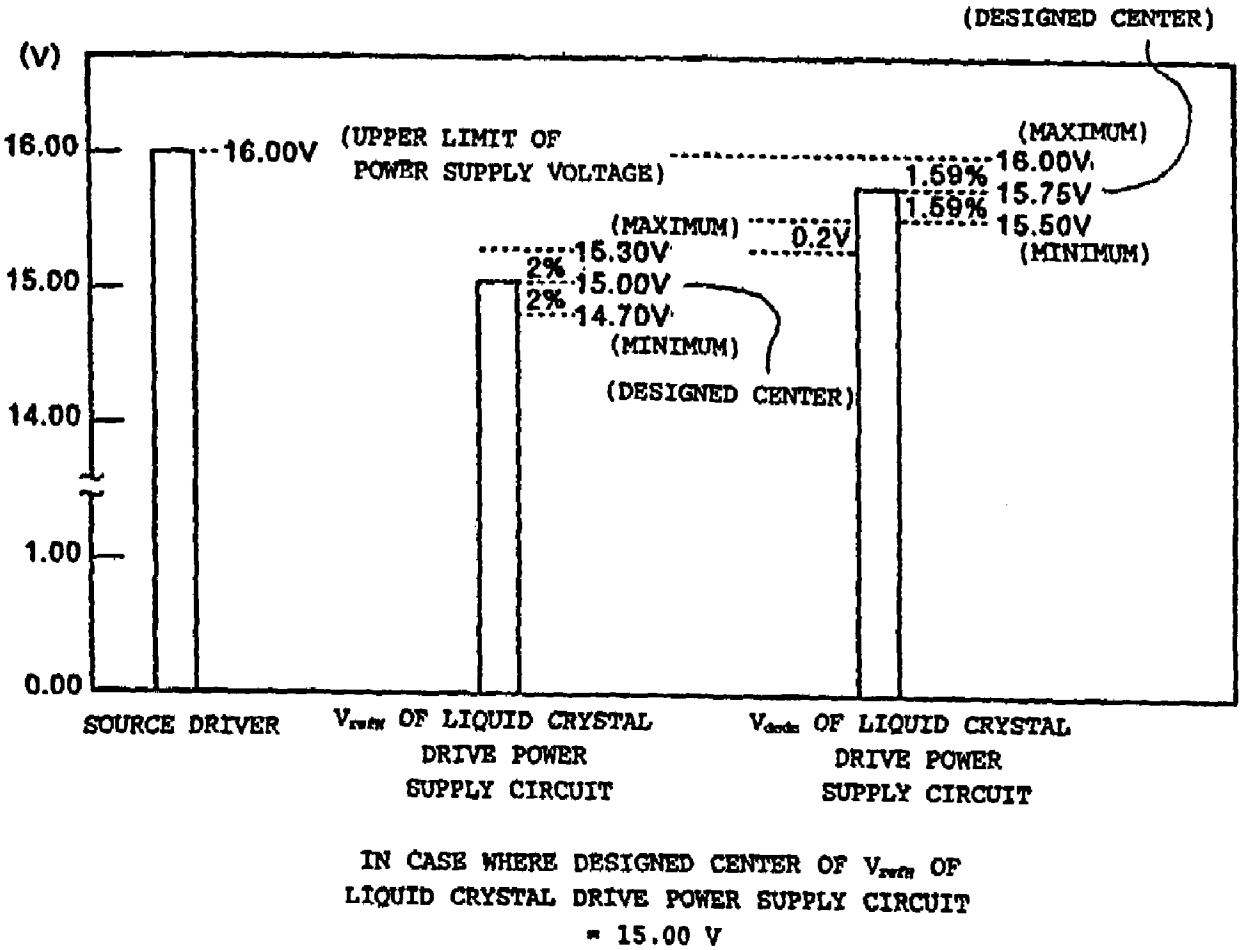
FIG.7 PRIOR ART
FIG. 7 is an explanatory view of an example of a conventional liquid crystal power supply circuit.
Figure 8:
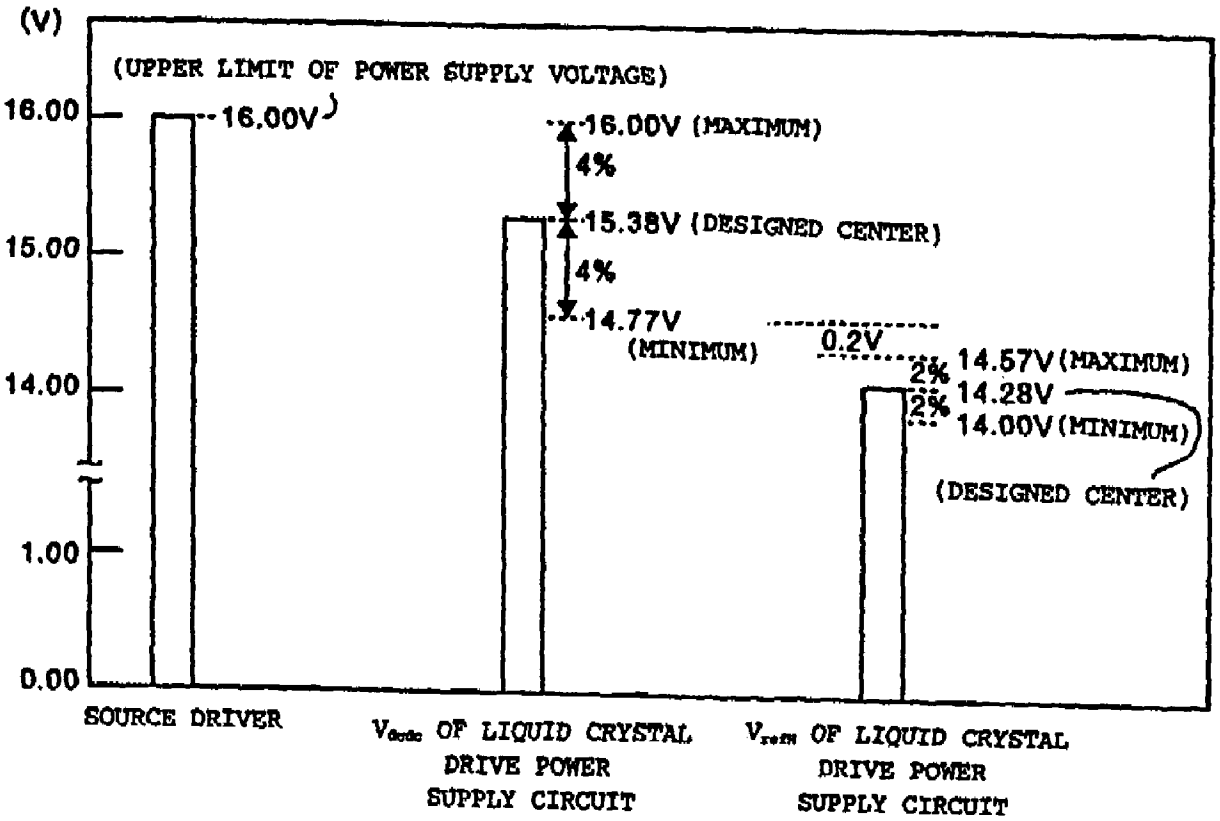
FIG. 8 PRIOR ART
FIG. 8 is an explanatory view of a second example of a conventional liquid crystal power supply circuit.

The error amplifying unit 44 sets a voltage obtained by dividing reference voltage $V_{REF}$ in the dividing network of resistors R1 and R2 as a non-inversion input, sets a difference voltage outputted from the comparison unit 46 as an inversion input, and amplifies a difference between those voltage inputs. The PWM conversion unit 32 outputs an oscillation signal $V_{out}$ having a pulse width in response to the size of the difference voltage outputted from the error amplifying unit 44. It should be noted that this arrangement (including the error amplifying unit 44, the comparison unit 46 and the internal reference voltage generating unit 42) is equivalent to the conventional DC/DC converter control circuit 120 shown in FIG. 5, except that the difference voltage from the comparison unit 46 is inputted to the error amplifying unit 44 as an inversion input thereto. Voltage output circuit 30 may be a switching regulator, a series regulator, a shunt regulator or the like.

The stabilized power supply circuit 60 is a series regulator or a shunt regulator having a tolerance of, for example, 2%, and generates the highest-level reference potential $V_{refH}$ with the drive power supply voltage $V_{dcdc}$ outputted from the DC/DC converter 34 taken as a power supply. Note that the stabilized power supply circuit 60 may be operated so that the highest-level reference potential $V_{refH}$ can actively vary in accordance with, for example, a change of the common electrode potential.

The comparison unit 46 sets the drive power supply voltage $V_{dcdc}$ outputted from the DC/DC converter 34 as a non-inversion input, sets the highest-level reference potential $V_{refH}$ outputted from the stabilized power supply circuit 60 as an inversion input, and delivers an output according to the difference between those voltages.

When the drive power supply voltage $V_{dcdc}$ and the highest-level reference potential $V_{refH}$ have target sizes, the resistance values of the resistors R1 and R2 may advantageously be chosen so that the difference voltage outputted from the comparison unit 46 and the voltage obtained by dividing internal reference voltage $V_{REF}$ using resistors R1 and R2 (hereinafter referred to as a reference voltage) are equal; feedback control is then realized for maintaining a specified voltage relation between the drive power supply voltage $V_{dcdc}$ actually outputted and the highest-level reference potential $V_{refH}$ outputted from the stabilized power supply circuit 60. In particular, the drive power supply voltage $V_{dcdc}$ outputted by power supply circuit 11 may be maintained at a constant voltage difference with respect to the highest-level reference potential $V_{refH}$ outputted from the stabilized power supply circuit 60.

As described above, in the power supply circuit 11, the difference voltage between the drive power supply voltage $V_{dcdc}$ and the highest-level reference potential $V_{refH}$ serves as a feedback control quantity. Therefore, while the drive power supply voltage $V_{dcdc}$ can be stably outputted, the difference between the drive power supply voltage $V_{dcdc}$ and the highest-level reference potential $V_{refH}$ can be kept constant.

Note that, if the power supply voltage $V_{cc}$ of the power supply circuit 11 is equal to or greater than a voltage obtained by adding the upper rail voltage of the stabilized power supply circuit 60 to the target highest-level reference potential $V_{refH}$, then the power supply voltage $V_{cc}$ can be utilized as the power supply voltage of the stabilized power supply circuit 60. However, in general, the upper rail voltage of the source driver and the upper rail voltage of the stabilized power supply circuit 60 are approximately at the same level. Therefore, the drive power supply voltage $V_{dcdc}$ outputted from the DC/DC converter 34 is used here as the power supply voltage of the stabilized power supply circuit 60. The stabilized power supply circuit 60 can generate the highest-level reference potential $V_{refH}$ from the drive power supply voltage $V_{dcdc}$ larger than the highest-level reference potential $V_{refH}$ to be generated. Accordingly, a regulator IC such as a series regulator can be used. Furthermore, since a voltage drop range in generating the highest-level reference potential $V_{refH}$ is small to an extent of the upper rail voltage, heating of the stabilized power supply circuit 60 is reduced.

Figure 3:
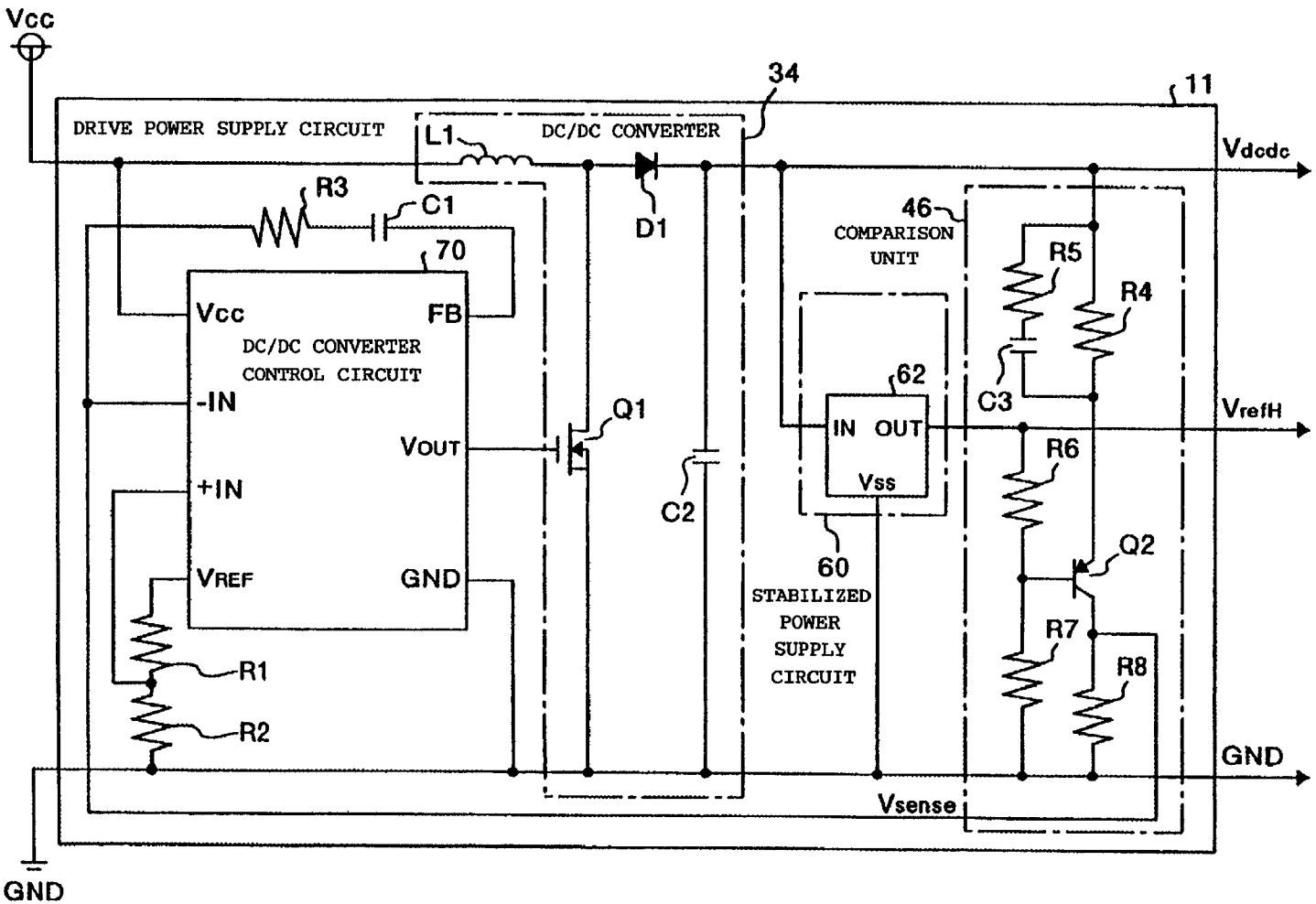
FIG. 3 is a circuit diagram showing more details of the power supply circuit according to the second embodiment of the invention.

Additional details of the power supply circuit 11 in accordance with this embodiment are given in FIG. 3. Note that, in FIG. 3, portions corresponding to the components shown in FIG. 2 are denoted by the same reference numerals.

In the power supply circuit 11 shown in FIG. 3, a general PWM controller IC including PWM conversion unit 32, internal reference voltage generating unit 42 and error amplifying unit 44, is used as a DC/DC converter control circuit 70. In FIG. 3, the DC/DC converter control circuit 70 includes a $V_{cc}$ terminal, a GND terminal, a −IN terminal, a +IN terminal, an FB terminal, a $V_{REF}$ terminal and $V_{OUT}$ terminal. The $V_{cc}$ terminal supplies the power supply voltage $V_{cc}$ to the DC/DC converter control circuit 70, and the GND terminal is a terminal connected to a GND line. The −IN terminal is connected to an inversion input terminal of the error amplifying unit 44 inside the power supply circuit 11, and the +IN terminal is connected to a non-inversion input terminal thereof. The FB terminal is connected to an output terminal of the inside error amplifying unit 44. The $V_{REF}$ terminal is connected to an output terminal of the inside internal reference voltage generating unit 42. The $V_{OUT}$ terminal is connected to an output terminal of the inside PWM conversion unit 32.

A resistor R3 and a capacitor C1, which are externally attached between the FB terminal and the −IN terminal in the DC/DC converter control circuit 70, are circuit elements constituting the feedback loop of the error amplifying unit 44. These elements perform gain adjustment and phase compensation of the error amplifying unit 44. Note that the resistor R3 and the capacitor C1 are connected in series in FIG. 3 but may be connected in parallel. Moreover, instead of the resistor R3 and the capacitor C1, a circuit network having an arbitrary impedance characteristic required for phase compensation of the error amplifying unit 44 may be provided.

In FIG. 3, resistors R1 and R2 are a voltage divider network for dividing the internal reference voltage $V_{REF}$ generated in the internal reference voltage generating unit 42. The voltage across resistor R2 is inputted to the +IN terminal as a non-inversion input to the error amplifying unit 44. Alternatively, the internal reference voltage $V_{REF}$ may be directly inputted to the +IN terminal without using a resistor dividing network.

The DC/DC converter 34 is a general boost circuit which includes an N-channel MOS transistor Q1, an inductor L1, a diode D1 and a capacitor C2. The DC/DC converter 34 carries out an operation similar to the switching regulator. A brief description of the configuration and operation thereof is as follows.

In FIG. 3, the DC/DC converter 34 inputs, as an input voltage, the power supply voltage $V_{cc}$ of the power supply circuit 11 to the inductor L1. The DC/DC converter 34 also inputs to a gate of N-channel MOS transistor Q1 a signal outputted from the $V_{OUT}$ terminal of the DC/DC converter control circuit 70; that is, the oscillation signal $V_{OUT}$ outputted from the PWM conversion unit 32. Then, by switching the N-channel MOS transistor Q1 in response to the oscillation signal $V_{OUT}$, energy accumulated in the inductor L1 when the N-channel MOS transistor Q1 is in an ON state is discharged through diode D1 when the N-channel MOS transistor Q1 is in an OFF state. The drive power supply voltage $V_{dcdc}$ is obtained by iterating such a discharge operation.

The stabilized power supply circuit 60 includes a three-terminal regulator IC 62 or the like, and generates a stable highest-level reference voltage $V_{refH}$ from the drive power supply voltage $V_{dcdc}$ outputted from the DC/DC converter 34.

The comparison unit 46 has five resistors R4, R5, R6, R7 and R8, a capacitor C3 and a PNP transistor Q2. One end of resistor R4 is connected to an output terminal of the DC/DC converter 34 (that is, a terminal at which the drive power supply voltage $V_{dcdc}$ is outputted), and the other end thereof is connected to an emitter of the PNP transistor Q2. In addition, one end of resistor R8 is connected to a collector of the PNP transistor Q2, and the other end thereof is connected to the GND line. One end of the resistor R6 is connected to an output terminal of the stabilized power supply circuit 60 (that is, the terminal to which the highest-level reference voltage $V_{refH}$ is outputted), and the other end thereof is connected to a base of the PNP transistor Q2. One end of resistor R7 is connected to the base of the PNP transistor Q2, and the other end thereof is connected to the GND line. Furthermore, resistor R5 and capacitor C3 are connected in series, connected to the resistor R4 in parallel, and operate as a circuit for phase compensation.

With the connections in comparison unit 46 as described above, the PNP transistor Q2 functions as a base-grounded amplifier, and the potential of the resistor R8 is varied substantially in proportion to the voltage difference between the drive power supply voltage $V_{dcdc}$ and the highest-level reference voltage $V_{refH}$. Specifically, when the drive power supply voltage $V_{dcdc}$ has a larger value than the highest-level reference voltage $V_{refH}$, a difference between the emitter potential and the base potential of the PNP transistor Q2 is increased, and thus the current in resistor R4 is increased. Since the PNP transistor Q2 functions as a base-grounded amplifier, the current in resistor R4 is approximately equal to the current in resistor R8; the voltage of the resistor R8 is thus increased. On the other hand, when the drive power supply voltage $V_{dcdc}$ has a smaller value than the highest-level reference voltage $V_{refH}$, the potential of the resistor R8 is lowered. The potential of resistor R8 thus can be taken out as a difference voltage $V_{sense}$ in accordance with the difference between the drive power supply voltage $V_{dcdc}$ and the highest-level reference voltage $V_{refH}$.

It should be noted that a voltage obtained by dividing the highest-level reference voltage $V_{refH}$ in the resistor network of R6 and R7 is applied to the base of the PNP transistor Q2. In other words, a voltage which is lower than the highest-level reference voltage $V_{refH}$ by an amount of voltage across R6 is applied to the base of the PNP transistor Q2. Thus, even if the voltage difference between the drive power supply voltage $V_{dcdc}$ and the highest-level reference voltage $V_{refH}$ is less than a voltage between the base and the emitter of the PNP transistor Q2 in the forward direction, operating conditions of the PNP transistor Q2 are still satisfied, and it is possible to compare the drive power supply voltage $V_{dcdc}$ and the highest-level reference voltage $V_{refH}$ when there is such a small voltage difference.

The resistance values of the resistors R4, R6, R7 and R8 are chosen so that the potential in the resistor R8 (that is, the difference voltage $V_{sense}$) can coincide with the above-described reference voltage (that is, the voltage applied to the resistor R2) in the case where the drive power supply voltage $V_{dcdc}$ and the highest-level reference voltage $V_{refH}$ show desired target voltage values.

The difference voltage $V_{sense}$ taken out from the comparison unit 46 is inputted to the –IN terminal of the DC/DC converter control circuit 70. Thus, the DC/DC converter control circuit 70 compares the difference voltage $V_{sense}$ inputted to the –IN terminal with the reference voltage inputted to the +IN terminal, and outputs the oscillation signal $V_{out}$ in response to this voltage difference.

When the difference voltage $V_{sense}$ is higher than the reference voltage, drive power supply voltage $V_{dcdc}$ is reduced. Conversely, when the difference voltage $V_{sense}$ is lower than the reference voltage, the drive power supply voltage $V_{dcdc}$ is increased. Thus, the drive power supply voltage $V_{dcdc}$ is controlled so as to maintain a potential difference that is R4/R8 times the reference voltage amount with respect to the highest-level reference potential $V_{refH}$.

Figure 4:
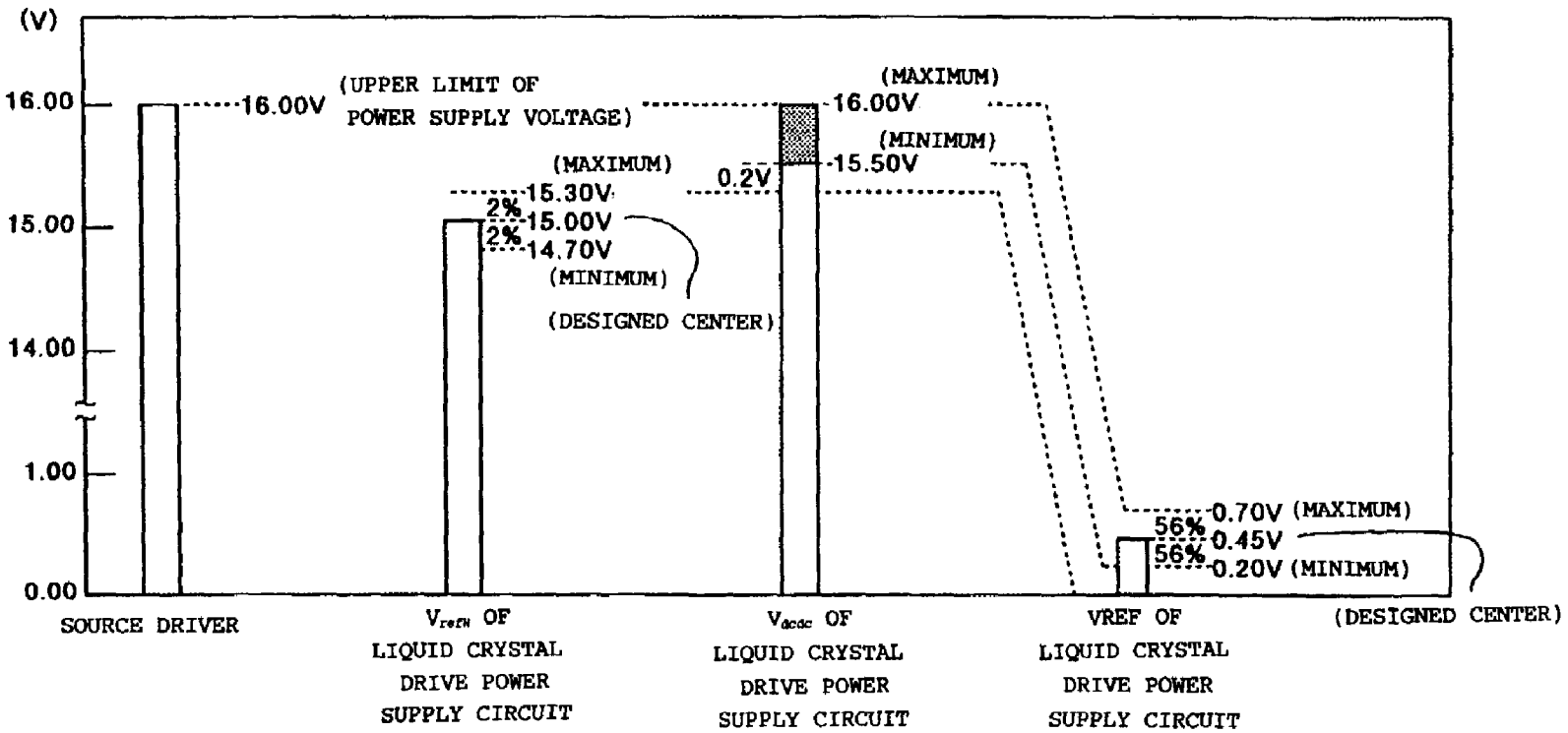
FIG. 4 is an explanatory view for explaining an operation of the power supply circuit according to the second embodiment of the invention.

A specific example, using numerical values, of the liquid crystal power supply circuit shown in FIG. 3 is as follows. It is assumed that resistance values are: R6=short circuit, R7= open circuit, R8=R4. It is also assumed that the voltage between the emitter and the base of transistor Q2=0 in the comparison unit 46. FIG. 4 explains the operation of the power supply circuit according to the present embodiment. In order to facilitate comparison thereof with the operation of the conventional liquid crystal power supply circuit, it is assumed that the maximum voltage the source driver must output is equal to the highest-level reference voltage $V_{refH}$ and that the upper rail voltage of the source driver is 0.2 V.

The upper limit of the power supply voltage that can be inputted to the source driver is assumed to be 16.00 V, and the designed central value of the highest-level reference voltage $V_{refH}$ is assumed to be 15.00 V. It is also assumed that the high-precision three-terminal regulator IC 62 has a tolerance of 2% in the generated voltage as the stabilized power supply circuit 60.

In accordance with the conditions described above, as shown in FIG. 4, the maximum value of the highest-level reference voltage $V_{refH}$ generated by the stabilized power supply circuit 60 becomes 15.30 V (=15.00×1.02), and the minimum value thereof becomes 14.70 V (=15.00×0.98). Since the drive power supply voltage $V_{dcdc}$ generated by the DC/DC converter 34 must be larger than the highest-level reference voltage $V_{refH}$ by the amount of the upper rail voltage, the drive power supply voltage $V_{dcdc}$ must be set at least at 15.50 V, which is higher than the maximum value 15.30 V of the highest-level reference potential $V_{refH}$ by 0.2 V.

A power supply circuit 11 is thus required which generates a drive power supply voltage $V_{dcdc}$ in a range of 15.50 V to 16.00 V. As described above, the power supply circuit 11 controls the DC/DC converter 34 to generate the drive power supply voltage $V_{dcdc}$ so that the difference between the drive power supply voltage $V_{dcdc}$ and the highest-level reference voltage $V_{refH}$ generated by the stabilized power supply circuit 60 (that is, difference voltage $V_{sense}$) can coincide with the reference voltage corresponding to a partial voltage of the internal reference voltage $V_{REF}$ generated by the internal reference voltage generating unit 42 of the DC/DC converter control circuit 70 (that is, $V_{REF}$R2/(R1+R2)). If this reference voltage is in a range between (i) the upper rail voltage 0.2 V (that is, the difference between the minimum value 15.50 V of the drive power supply voltage $V_{dcdc}$ and the maximum value 15.30 V of the highest-level reference potential $V_{refH}$) and (ii) 0.70 V (that is, the difference between the maximum value 16.00 V of the drive power supply voltage $V_{dcdc}$ and the maximum value 15.30 V of the highest-level reference potential $V_{refH}$), the drive power supply voltage $V_{dcdc}$ can be set within the above-described range of 15.50 V to 16.00 V.

For the above-described reference voltage to be in this range, the internal reference voltage generating unit 42 is required to have a tolerance of merely 56% in the generated voltage with a designed central voltage of 0.45 V (see FIG. 4). Accordingly, adoption of an internal reference voltage generating unit 42 having a low-precision specification is allowed. In practice, a tolerance in the generated voltage of the internal reference voltage generating unit 42 of the inexpensive PWM controller IC is about 4%. Even if such an inexpensive PWM controller IC is adopted as the DC/DC converter control circuit 70, the above-described specification can be fully satisfied. Furthermore, the range of the tolerance in the generated voltage, can be divided among errors in resistance values of the externally attached resistors such as R1 and R2, voltage variations of the drive power supply voltage $V_{dcdc}$ and the highest-level reference voltage $V_{refH}$ due to load variation, and a variation due to aging of the circuit components.

In the power supply circuit according to this embodiment, a feedback control is established for generating the drive power supply voltage $V_{dcdc}$ so that the difference voltage between the drive power supply voltage and the highest-level reference voltage $V_{refH}$ can be equal to a specified reference voltage; accordingly, a relation between the drive power supply voltage $V_{dcdc}$ and the highest-level reference voltage $V_{refH}$ can be kept constant.

The allowable range of the reference voltage can be expressed in the following equations:

Lower limit value=Upper rail voltage of source driver; and

Upper limit value=Upper limit of power supply voltage of source driver−(maximum value of highest-level reference voltage $V_{refH}$ generated by stabilized power supply circuit+upper rail voltage of source driver)

In general, the upper rail voltage of the source driver is as small as about 0.2 V. Thus, if the designed central voltage of the highest-level reference voltage $V_{refH}$ is similar to the conventional one, the following relation is established:

(Upper limit of power supply voltage of source driver−maximum value of highest-level reference voltage $V_{refH}$ generated by stabilized power supply circuit)>Upper rail voltage Therefore, the allowable range of the internal reference voltage required for generating the reference voltage can be greater than the error range of the voltage generated by a low-precision voltage generating circuit. Even if the internal reference voltage generating unit has a low-precision and inexpensive voltage generating circuit, the drive power supply voltage $V_{dcdc}$ can be generated with high precision, similarly to a conventional arrangement where a high-precision voltage generating circuit is used.

In particular, in the case of generating the highest-level reference voltage $V_{refH}$ and the drive power supply voltage $V_{dcdc}$ independently of each other in a conventional liquid crystal power supply circuit, the designed central voltage of the highest-level reference voltage $V_{refH}$ has been required to be set low, in consideration of a wide-range error obtained by superposing the error in generating the highest-level reference voltage $V_{refH}$ upon the error in generating the drive power supply voltage $V_{dcdc}$. Alternatively, in conventional arrangements a high-precision voltage generating circuit has been required to be mounted on the power supply circuit. In the liquid crystal power supply circuit of the present invention, by contrast, it is sufficient if only a relative error between the highest-level reference voltage $V_{refH}$ and the drive power supply voltage $V_{dcdc}$ is taken into consideration. Therefore, there is greater flexibility in the error range of the voltage generating circuit to be mounted. Hence, the error originating from other causes such as externally attached resistors can be easily accommodated, and the designed central voltage of the highest-level reference voltage $V_{refH}$ can be set higher than in conventional arrangements.

Note that the reference potential generating circuit 150 can be included in the above-described power supply circuit. In this case, the drive power supply voltage $V_{dcdc}$ is supplied to the source driver from the power supply circuit and the plurality of reference potentials $V_{ref0}$ to $V_{refn}$ are outputted to the source driver. In addition, in the power supply circuit explained in the above-described embodiment, the drive power supply voltage $V_{dcdc}$ and the highest-level reference voltage $V_{refH}$ outputted from the stabilized power supply circuit 60 are compared with each other; however, instead of the highest-level reference voltage $V_{refH}$ as one of the objects to be compared, the plurality of reference voltages $V_{ref0}$ to $V_{refn}$ outputted from the foregoing reference potential generating circuit 150 may be used.

The power supply circuit explained in the above-described embodiment can supply a drive power supply voltage and a reference voltage not only to the source driver for a liquid crystal display panel but also to a driver circuit for driving another display device, such as a light-emitting display using an active matrix-polymer light emitting diode (AM-PLED) or an active matrix-organic light emitting diode (AM-OLED), which controls light emission thereof by scanning an active element with a voltage applied to an organic polymer film.

The power supply circuit explained in the above-described embodiments can be substituted for the power supply circuit used in conventional display devices such as a liquid crystal display module. Such a display device may include one of various display panels such as a liquid crystal display panel and the above-described light-emitting type display, driver circuits for the scan driver and the source driver, a power supply circuit according to the present invention, the reference potential generating circuit, a controller generally controlling the components, a backlight unit and the like.

As described above, in accordance with the power supply circuit, the driver circuit voltage generating method and the display device according to the present invention, with the stable reference voltage outputted from the reference voltage generating circuit taken as a reference, the drive power supply voltage is generated so that a relation thereof with the reference voltage can be constant. Therefore, the drive power supply voltage and the highest-level reference voltage for generating the gray-scale voltage can be generated by using a DC/DC converter control circuit including a low-precision reference voltage source, with a precision similar to that of a conventional power supply circuit using a DC/DC converter control circuit including a high-precision reference voltage source.

Although preferred embodiments of the present invention have been described in detail, it should be understood that various changes, substitutions and alternations can be made therein without departing from spirit and scope of the inventions as defined by the appended claims.

We claim:

1. A power supply circuit, comprising:

a voltage output circuit for generating a drive power supply voltage for a driver circuit for use in a display device, said voltage output circuit outputting said drive power supply voltage while changing a value thereof in response to an inputted control signal;

a reference voltage generating circuit for generating a first reference voltage, input to the driver circuit, for use in generating a gray-scale voltage in said driver circuit; and a comparison circuit for performing a comparison of the drive power supply voltage and the first reference voltage to output said control signal in response to a result of the comparison, said comparison circuit including a comparison unit having the drive power supply voltage as a first input, having the first reference voltage as a second input, and delivering an output according to a difference between said first input and said second input, a reference voltage generating unit for generating a second reference voltage, and a difference amplifying unit for outputting said control signal based on a difference voltage between (1) the output of the comparison unit and (2) the second reference voltage, wherein the reference voltage generating unit generates said second reference voltage independently of said drive power supply voltage and said first reference voltage, and feedback control is performed to maintain a specified relation between said drive power supply voltage and said first reference voltage.

2. The power supply circuit according to claim 1, wherein said reference voltage generating circuit generates said first reference voltage by a stabilized power supply circuit.

3. The power supply circuit according to claim 1, wherein said reference voltage generating circuit generates said first reference voltage from said drive power supply voltage.

4. The power supply circuit according to claim 1, wherein said reference voltage generating circuit generates a voltage corresponding to a maximum potential among a plurality of reference potentials required for generating a gray-scale voltage in said driver circuit, and outputs the generated voltage as said first reference voltage.

5. The power supply circuit according to claim 1, wherein said reference voltage generating circuit generates a voltage corresponding to a maximum potential among a plurality of reference potentials required for generating a gay-scale voltage in said driver circuit, and generates said plurality of reference potentials based on the generated voltage.

6. The power supply circuit according to claim 1, wherein said voltage output circuit includes:

a pulse width modulation (PWM) controller for outputting pulse signals, each of said pulse signals having a width in response to control signals outputted from said comparison circuit; and a DC/DC converter controlled by said pulse signals.

7. A display device, comprising:

a display panel including a plurality of pixels arrayed in a matrix, said display panel being for displaying an image by said plurality of pixels;

a driver circuit for outputting a gray-scale voltage to said plurality of pixels based on a plurality of reference potentials; and a power supply circuit including a voltage output circuit for outputting a drive power supply voltage for said driver circuit, said voltage output circuit outputting said drive power supply voltage while changing value thereof in response to an inputted control signal, a reference voltage generating circuit for outputting a first reference voltage to said driver circuit for deciding said plurality of reference potentials, a comparison circuit for performing a comparison of the drive power supply voltage and the first reference voltage to output said control signal in response to a result of the comparison, said comparison circuit including a comparison unit having the drive power supply voltage as a first input, having the first reference voltage as a second input, and delivering an output according to a difference between said first input and said second input, a reference voltage generating unit for generating a second reference voltage, and a difference amplifying unit for outputting said control signal based on a difference voltage between (1) the output of the comparison unit and (2) the second reference voltage, wherein the reference voltage generating unit generates said second reference voltage independently of said drive power supply voltage and said first reference voltage, and said power supply circuit performs feedback control to maintain a specified relation between said drive power supply voltage and said first reference voltage.

8. The display device according to claim 7, wherein said reference voltage generating circuit generates said first reference voltage by a stabilized power supply circuit.

9. The display device according to claim 7, wherein said reference voltage generating circuit generates a voltage corresponding to a maximum potential among said plurality of reference potentials, and outputs the generated voltage as said first reference voltage.

10. The display device according to claim 9, further comprising:

a reference potential generating circuit for generating said plurality of reference potentials based on said first reference voltage.

* * * * *